US006116451A

United States Patent [19]

Herrmann et al.

[11] Patent Number: 6,116,451

[45] **Date of Patent: *Sep. 12, 2000**

[54] SCREW CAP WITH ANTI-TAMPER STRIP

[75] Inventors: Klaus-Jürgen Herrmann, Rümmingen; Michael Kirchgessner, Egringen, both of Germany

[73] Assignee: Crown Cork AG, Reinach, Switzerland

[ * ] Notice: This patent is subject to a terminal disclaimer.

[21] Appl. No.: 09/229,923

[22] Filed: Jan. 13, 1999

Related U.S. Application Data

[63] Continuation of application No. 08/596,320, filed as application No. PCT/CH95/00132, Jun. 6, 1995, Pat. No. 5,893,474.

[30] Foreign Application Priority Data

Jun. 24, 1994 [CH] Switzerland ..... 2018/94

[51] Int. Cl.[7] ..... B65D 41/34

[52] U.S. Cl. ..... 220/252

[58] Field of Search ..... 215/252

[56] References Cited

U.S. PATENT DOCUMENTS

| | | | |
|---|---|---|---|
| 4,278,180 | 7/1981 | Willis | 215/252 |
| 5,111,947 | 5/1992 | Patterson | 215/252 |
| 5,248,050 | 9/1993 | Janousch et al. | 215/252 |
| 5,295,600 | 3/1994 | Kowal | 215/252 |
| 5,540,342 | 7/1996 | Rathbun | 215/252 |
| 5,893,474 | 4/1999 | Herrmann et al. | 215/252 |

FOREIGN PATENT DOCUMENTS

| | | |
|---|---|---|
| 0 337 046 | 10/1989 | European Pat. Off. . |
| 0 459 941 | 12/1991 | European Pat. Off. . |
| 0 564 999 | 10/1993 | European Pat. Off. . |
| 2255553 | 11/1992 | United Kingdom . |

*Primary Examiner*—Joseph M. Moy
*Attorney, Agent, or Firm*—Woodcock Washburn Kurtz Mackiewicz & Norris LLP

[57] ABSTRACT

A plastic anti-tamper strip (3) is provided at the lower edge of a screw cap (1). Bridges (20) form an approximately horizontal nominal rupture line, along which the anti-tamper strip can be separated from the screw cap (1) when a container, closed by said screw cap, is opened for the first time. A bead (8) is provided on the screw cap (1) which engages interlockingly with a bead (4) on the container mouth (2). The anti-tamper strip (3) also possesses at least one approximately vertical nominal rupture point (11). Adjacent to the nominal rupture point (11), a relief zone is provided, the stretchability of which increases towards the lower edge (19) of the anti-tamper strip (3).

15 Claims, 4 Drawing Sheets

SCREW CAP WITH ANTI-TAMPER STRIP

Figure 1:
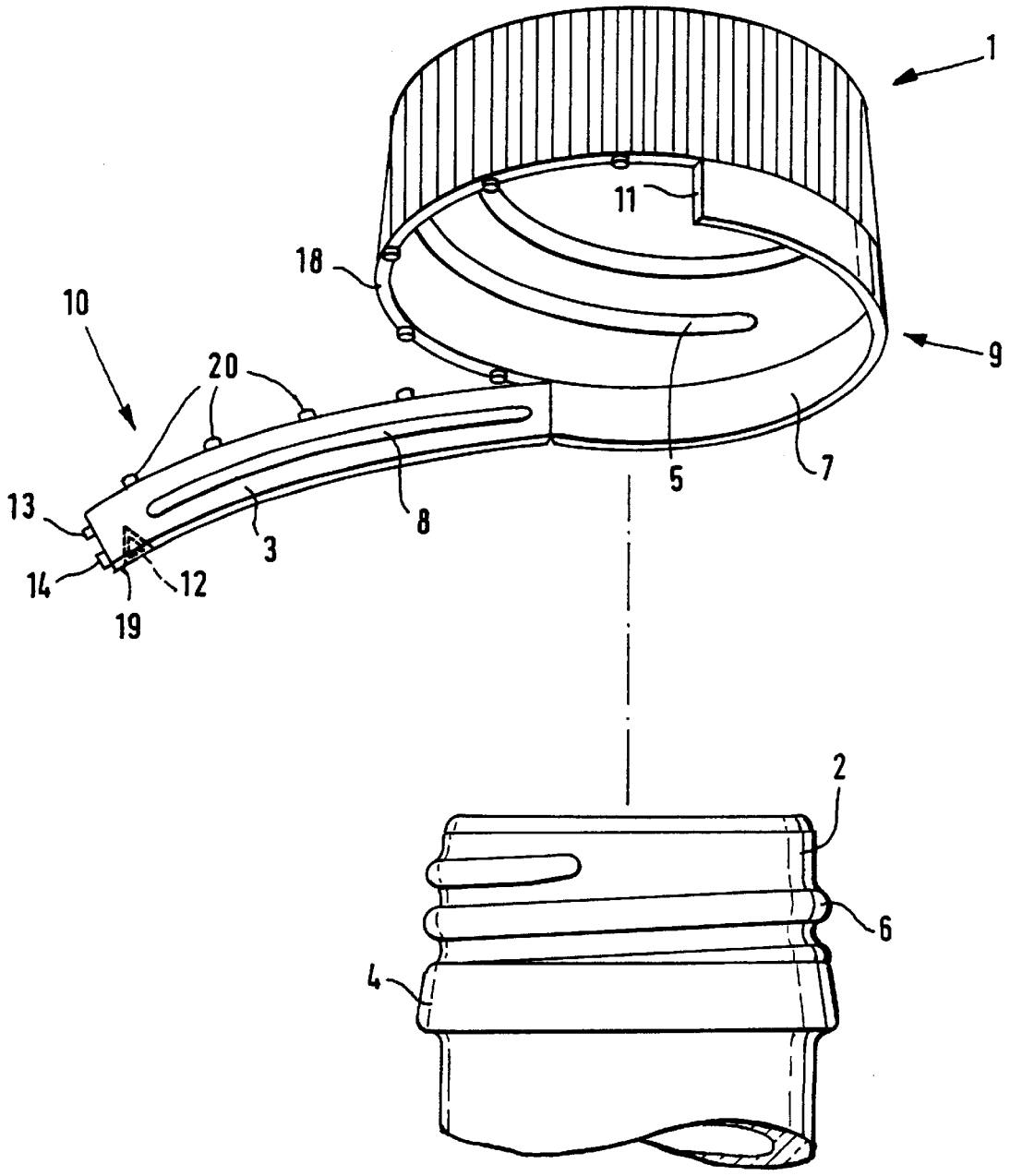

This Application is a continuation of application Ser. No. 08/596,320 filed Feb. 20, 1996, now U.S. Pat. No. 5,893,474 which is a continuation of PCT/CH95/00132 filed Jun. 6, 1995.

The invention concerns a screw cap for closure of a container mouth according to the preamble to claim 1. These types of screw caps are mostly manufactured in one piece by the injection molding method. There are also embodiments which are both state of the art and in use, with which the actual screw cap comprises sheet aluminium, for example, and the anti-tamper strip is connected to the screw cap as a separate component. Such caps are used mainly in the beverage industry. Because of predetermined bottling-plant speeds, which are constantly increasing, there is an ever decreasing time allowed for screwing on screw caps during closure of bottles. Accordingly, there is a risk that there will be insufficient time to slowly expand the anti-tamper strip during attachment and snap the anti-tamper strip retaining elements over the complementary protrusion or bead on the bottle, with consequent destruction of the anti-tamper strip during closure of the bottle.

With regard to the applicant's EP-A-1 459 941, a screw cap has been made known which, adjacent to the vertical nominal rupture point, contains at least one relief aperture. The relief aperture serves the purpose of creating greater in anti-tamper strip elasticity for the closure sequence.

In practice, it has now been demonstrated that, mainly in the case of high closure speeds and/or retaining elements possessing high resistance, the relief aperture must be of such large dimension that the anti-tamper strip is able to elastically expand also during opening, as a result of which the retaining element can, in certain cases, lift over the complementary protrusion on the bottle neck without the anti-tamper strip being subjected to rupturing.

The purpose of the invention is to avoid the disadvantages of the state of the art, and thus in particular to create a screw cap of the type mentioned in the introduction with which, during closure of the container opening, the anti-tamper strip can expand at the nominal rupture point without damage, however with no expansion occurring during initial screwing off which could inhibit the guarantee function. According to the invention, this purpose is fulfilled with a screw cap possessing the features of the patent claims. At the same time, a relief zone is mainly used adjacent to the nominal rupture point of the anti-tamper strip, the stretchability of which increases towards the lower edge of the anti-tamper strip. During screwing on, this will mainly enable the anti-tamper strip to progressively expand with relatively slight application of force when the anti-tamper strip is expanded from below upwards as a result of retaining elements and bottle bead coming into mutual contact. If, conversely, during initial opening, the retaining element or retaining elements make contact with the bottle bead, this will cause an expansion foce extending from the upper area of the anti-tamper strip. Since the stretchability will be slighter in the upper area as a result of the relief zone, the guarantee function will remain unaffected. In the expansion area, during expansion and the expansion hysteresis, a stabilisation of the material will occur, said stabilisation having a positive effect on the guarantee function.

Raising the stretchability thus also at the same time permits variable stretchability, for example by means of restricting the wall thickness, folding of the anti-tamper strip in the region of the relief zone or relief bridges of varying length and/or varying thickness. Relief zones which possess the form of a material thinning extending towards the lower edge of the anti-tamper strip have been particularly proven, said regions extending over a portion of the anti-tamper strip. From the point of view of both manufacturing technique and closure properties, approximately triangular relief zones have been proven, the lower side of the triangle coinciding with the lower side of the anti-tamper strip, and the tip of the triangle extending upwards in the direction of the closure cap. Appropriately, the triangle is approximately an isosceles triangle, and the angle at its upper tip amounts to 25° and 50°, and preferably 35°. The stretchability of the relief zone should be dimensioned in such a way, with regard to the plastic material used, that expansion of the relief zone is once again reabsorbed after closure of the container. A slight residual expansion can then be tolerated mainly if occurring only in the region of extreme over-dimension, and accordingly within the tolerance limit range of the container outer diameter.

The relief zone should extend at least over half the height of the anti-tamper strip, in order that the transition from relatively great stretchability at the lower edge of the anti-tamper strip to "zero stretchability" extends over a sufficient distance.

Insofar as the anti-tamper strip possesses a circumferential section along which it is connected with the lower edge of the screw cap, it is appropriate if the relief zone is arranged chiefly in the area of the section adjacent to the nominal rupture point, said section not being firmly connected, and in particular behind the nominal rupture point with regard to the direction of screwing on. When the anti-tamper strip is connected to the cap by nominal rupture bridges around its entire circumference, it is particulary appropriate if at least one relief zone is provided on both sides of the vertical nominal rupture point.

The invention is more closely explained in the following embodiments, and with the aid of the drawings, namely:

FIG. 1 a schematic representation of a screw cap with the features of the invention, after screwing onto a bottle neck, FIG. 2 a modified embodiment of a screw cap during closure, FIG. 3 the screw cap accoding to FIG. 2 after closure, FIG. 4 a modified embodiment of a relief zone on an anti-tamper strip, in enlarged scale, FIG. 5 a side view of an anti-tamper strip similar to FIG. 3, in enlarged scale FIG. 6 a side view from below of the anti-tamper strip according to FIG. 5, FIG. 7 a detail in enlarged scale of a further modified embodiment of a relief zone on an anti-tamper strip, FIG. 8 a side view from below of the anti-tamper strip according to FIG. 7, and FIGS. 9 and 10 a side view and a section of a modified relief zone.

FIG. 1 shows a plastic screw cap 1 with an inside thread 5, said cap serving to close a container mouth 2 possessing an outside thread 6. These types of screw caps are prefered for closing bottles containing beverages, returnable glass bottles with a standardised bottle opening normally being concerned. They can also be used with disposable glass or plastic bottles. As opposed to non-returnable plastic bottles, it is here significant that the anti-tamper strip 3 does not remain beneath the bead, since this would cause considerable extra effort when cleaning the bottle. Recycling of plastic bottles will also be facilitated. In the circumferential direction, the anti-tamper strip therefore possesses an approximately vertical nominal rupture point 11, said nominal rupture point causing the anti-tamper strip to be separable from the bottle opening and preferably remaining connected with the screw cap.

The anti-tamper strip 3 comprises a circumferential section 9 which is relatively firmly connected with the lower edge of the cap, and a tearable or not firmly fixed complementary section 10. A retaining element in the form of a bead 8 is arranged on the inside 7 of the anti-tamper strip, preferably on the complementary section 10, said retaining element snapping under the bead 4 on the container mouth 2 when screwing on for the first time, and causing the required tension force in order to tear the anti-tamper strip when screwing off for the first time.

The anti-tamper strip 3 is connected to the lower edge 18 of the cap 1 by means of bridges 20. The bridges 20 rupture when opening the cap 1 for the first time, and thus form an approximately horizontal nominal rupture point.

The vertical nominal rupture point 11 is formed by an upper material bridge 13 and a lower material bridge 14, said lower bridge being arranged on the lower edge 19 of the anti-tamper strip 3. Adjacent to the nominal rupture point 11, a relief zone 12 extends from the lower edge 19 of the anti-tamper strip 3 upward towards the screw cap. The relief zone 12 is formed to be approximately triangular, the lower side of the triangle coinciding with the lower edge 19 of the anti-tamper strip 3. The tip of the triangle points upwards towards the screw cap 1.

In the area of the relief zone, the material of the anti-tamper strip 3 wall is weakened by approximately one third of the wall thickness. In this way, the stretchability is raised without the risk of rupture in the region of the relief zone 12. The anti-tamper strip 3 has, in the case of screw caps for the standard commercial 28 mm bottle closures, an overall height of approximately 5 to 7 mm. The relief zone 12 extends at least over half the height of the anti-tamper strip. Through arranging the relief zone adjacent to the vertical nominal rupture point 11, in this area the stretchability is raised. Through the triangular form, the stretchability will be greatest in the area of the lower edge 19 of the anti-tamper strip 3. Said stretchability diminishes upwards according to the wedge shape of the relief zone, in accordance with FIG. 1. If, therefore, during closure of a bottle, the lower edge 19 of the anti-tamper strip 3 is expanded, the anti-tamper strip 3 can expand sufficiently in order to avoid rupture of the material bridges 13, 14 during the closing procedure, because the bead 8 is pressed over the bead 4 on the container mouth 2. When, however, the screw cap is opened for the first time, the upper side of the bead 8 will run up against the lower side of the bead 4 on the container mouth 2. Loading of the anti-tamper strip 3 will thus be from above downwards, with practically no increase in stretchability occurring in the upper area due to the wedge shape of the relief zone 12. Correspondingly, the anti-tamper strip 3 will not expand and the bridges 20 and the material bridges 13 and 14 will rupture, as shown in FIG. 1.

In the case of the embodiment according to FIG. 1, the relief zone 12 is accommodated on the inside of the anti-tamper strip. It can with advantage also be accommodated on the outside of the anti-tamper strip.

Figure 2:
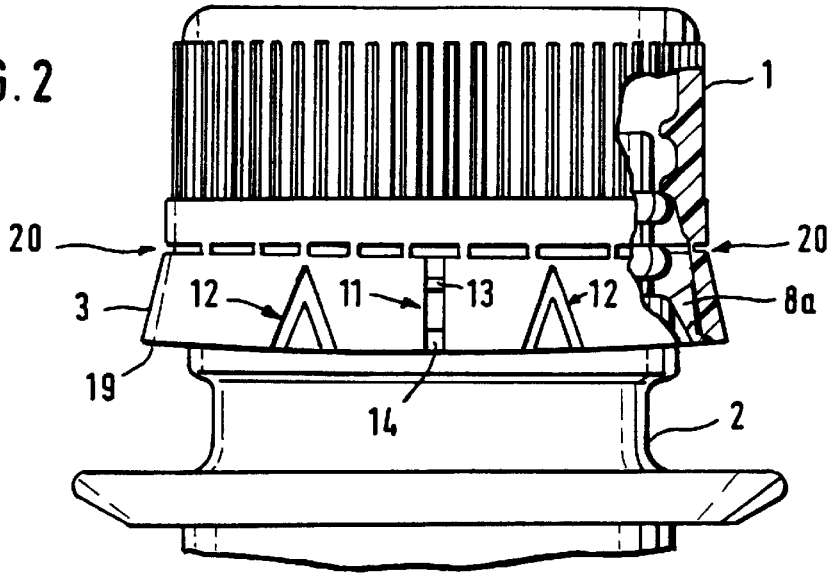
Figure 3:
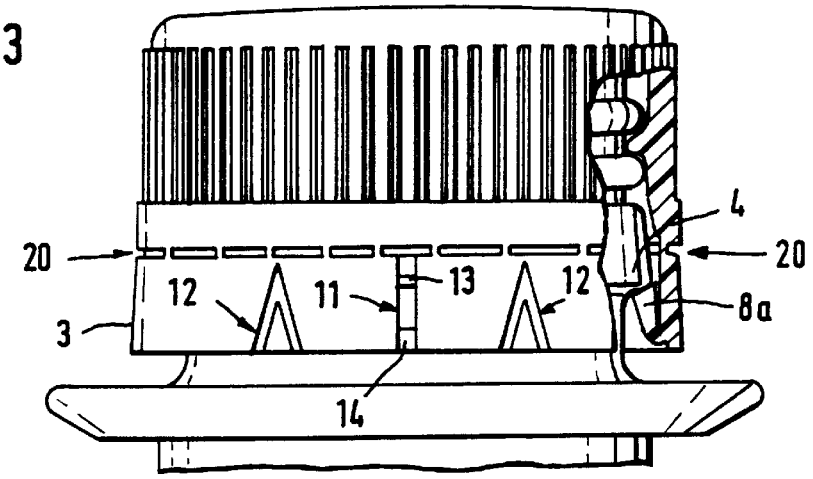

FIG. 2 shows a modified embodiment of the invention, with which the bridges 20, and thus the horizontal nominal rupture line, run around the entire circumference, in other words therefore, around 360° of the screw cap 1. According to FIGS. 2 and 3, the anti-tamper strip 3 is, in place of a bead 8, equipped in a known way with extensions 8*a* which can flap inwards, said extensions serving as retaining elements and coordinating with the bead 4 of the container mouth 2. As shown in FIGS. 2 and 3, a relief zone 12 is provided at each side of the vertical nominal rupture line 11. If, during closure of the bottle (FIG. 2) the lower edge 19 of the anti-tamper strip is expanded, the relief zones 12 cause raised stretchability of the anti-tamper strip 3, and thus prevent rupturing of the material bridges 13 and 14. After complete screwing on of the screw cap 1, the protrusions 8*a* make contact with the lower side of the bead 4. If the bottle is now opened, primarily a vertical force will be exerted on the anti-tamper strip 3, by which means the bridges 20 will rupture in order to incidicate initial opening. Insofar as a horizontal force component may result, said horizontal force component causing a radial expansion of the anti-tamper strip 3, this expansion will occur above the protrusions 8, in other words at the upper end of the anti-tamper strip 3 in the area of the bridges 20. In this area, the relief zones will have no effect, so that the anti-tamper function remains unaffected.

Figure 4:
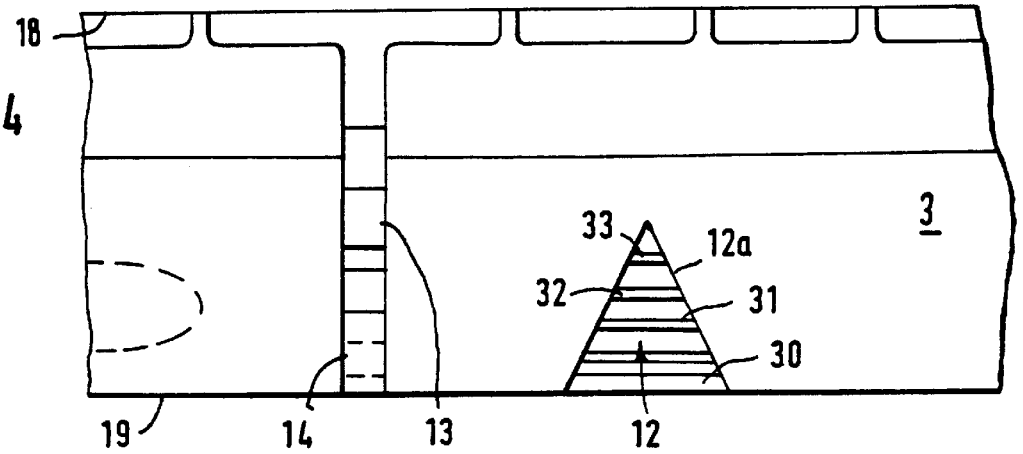

FIG. 4 shows a modified embodiment of a relief zone 12. In the area of the relief zone 12, an approximately wedge shaped recess 12*a* is provided in the anti-tamper strip 3. The recess 12*a* is bridged over by material bridges 30, 31, 32, 33 which are injection molded in one piece, said material bridges running horizontally. The material bridges 30 to 33 are of differing thicknesses and lengths so that, under load, they possess varying expansion characteristics. With that, the lowermost material bridge 30 is able to expand the most, so that the protective function for the bridges 13, 14 of material is assured, similar to FIGS. 2 and 3.

Figure 5:
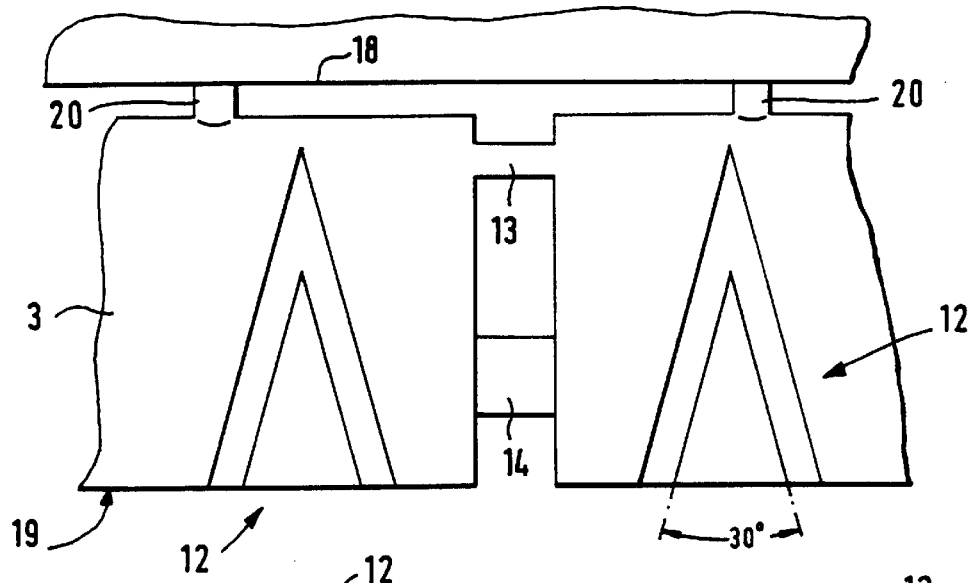
Figure 6:
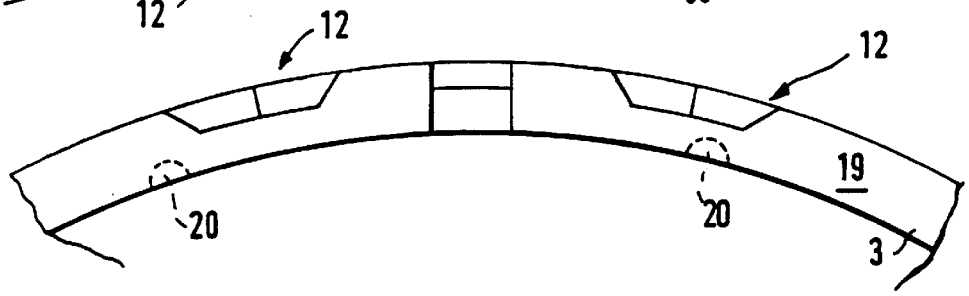

FIGS. 5 and 6 show a relief zone 12 with a material thinning of the anti-tamper strip running in a wedge shape, said thinning being approximately 50% of the material thickness. The material thinning possesses an open angle of approximately 30°, the lower side of the relief zone coinciding with the lower edge 19 of the anti-tamper strip 3.

Figure 7:
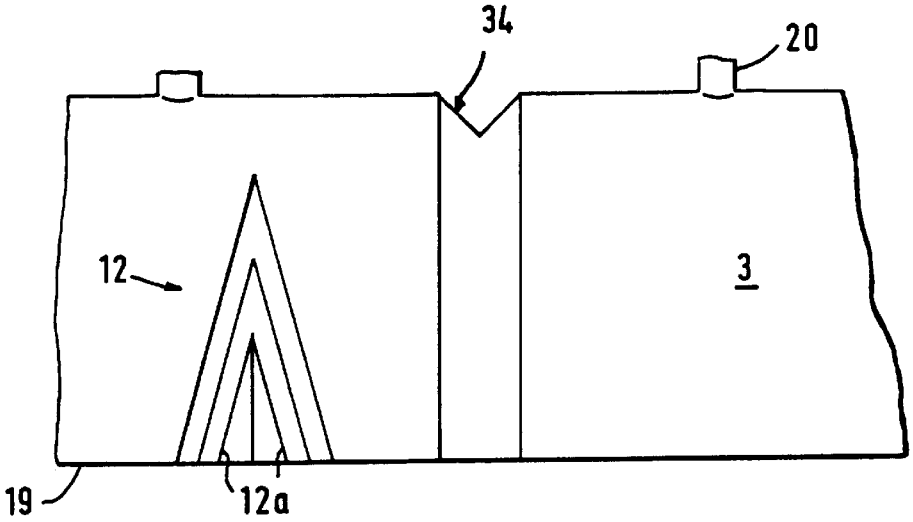
Figure 8:
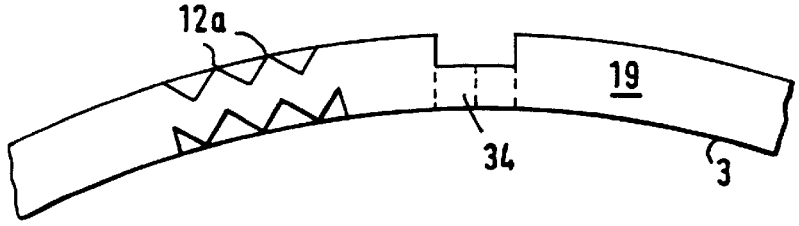

FIGS. 7 and 8 show a modified embodiment with which, instead of the material bridges 13 and 14, a thin membrane 34 is provided to form the vertical nominal rupture point 11. A relief zone 12 is provide adjacent to the vertical nominal rupture point, said relief zone possessing a corrugated wall section 12*a*. The stretchability of the relief zone 12 is, with that, once again greatest in the area of the lower edge of the anti-tamper strip 3. During closure of the bottle, as soon as the lower edge of the anti-tamper strip 19 is subjected to a high tension force, the relief zone 12 will expand in the manner of a bellows so that the load on the membrane 34 is reduced.

The optimum arrangement of the relief zone 12, as well as its configuration and height, mainly depends on the selected material, the stretchability required, the dimensions of the material bridges 13, 14 and the bridges 20. In practice, the arrangement can be easily optimised.

Figure 9:
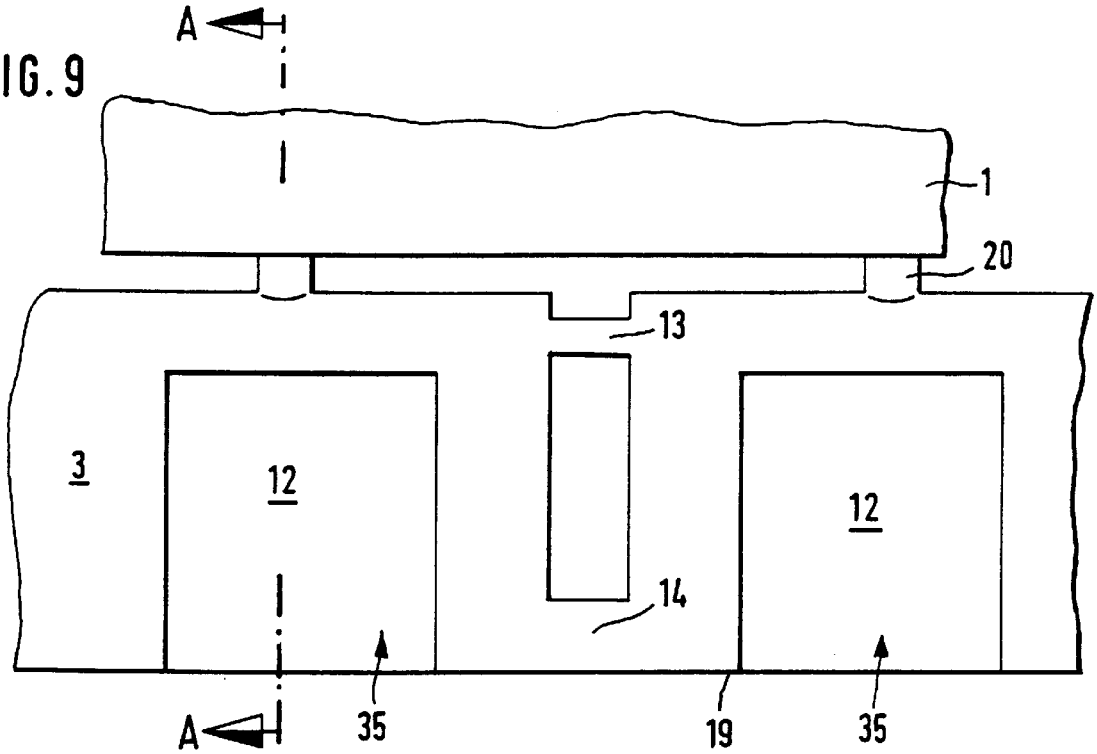
Figure 10:
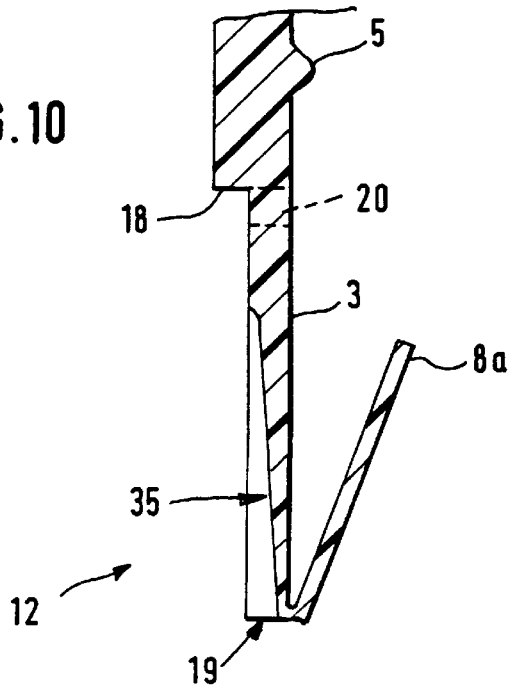

FIGS. 9 and 10 show an embodiment of an anti-tamper strip with modified relief zone 12. With that, FIG. 10 shows a schematic section along the line A—A pertaining to FIG. 9. Insofar as the embodiment in FIGS. 9 and 10 corresponds to the embodiment according to FIGS. 2 and 3, the same components are designated in the same way.

As shown, two relief zones 12 are provided which possess material thinning 33 running downwards approximately cross-sectionally in the form of a wedge. In the plan view, the material thinnings 33 are approximately rectangular. Since the wall thickness of the anti-tamper strip 3 becomes progressively thinner in the downwards direction in the area of the material thinning 33, and the thinnest point is attained in the area of the lower edge 19, the stretchability of the anti-tamper strip will increase progressively in the downward direction, although the relief zone in the side view is not wedged shaped but approximately rectangular.

Evidently, the degree of material weakening and the reduction of material can be dimensioned in line with the actual material and the expansion requirements in such a way that the improvement in stretchability during closure can be ensured.

Naturally, the variants according to FIGS. 9 and 10 can be combined with the variants according to FIGS. 1 to 8. This would mean, for example, that with a wedge shaped relief zone according to FIG. 2 or 6, or with a corrugated relief zone according to FIG. 8, a material weakening 33 is additionally provided in order to raise the stretchability of the relief zone in this area.

In order to simplify the representation, in the case of the embodiments only one nominal rupture point 11 has been shown. Naturally, the invention can also be employed with screw caps which possess two or more vertical nominal rupture lines. The bridges 20 are shown as having the same thickness in FIGS. 2 and 3. Naturally, it is also conceivable to form one of the bridges to be thicker, in order to hold the remaining bridges onto the screw cap 1 after tearing. When a plurality anti-tamper strip sections separated by vertical nominal rupture points 11 should be provided, each of these sections can possess a thickened bridge for permanent connection with the screw cap, as well as at least one relief zone in the area adjacent to the vertical nominal rupture point.

Inasmuch as the invention is subject to modifications and variations, the foregoing description and accompanying drawings should not be regarded as limiting the invention, which is defined by the following claims and various combinations thereof:

What is claimed is:

1. A screw cap for closure of a container mouth, comprising:

a lower edge;

a circumferential anti-tamper strip of a plastic material arranged on said lower edge and integral therewith, said anti-tamper strip having an inside and a lower edge;

at least one retaining element arranged on said inside of said anti-tamper strip for engaging said anti-tamper strip beneath a protrusion on the container mouth;

at least one substantially vertical nominal rupture point circumferentially arranged on said anti-tamper strip and adapted to separate said anti-tamper strip over its entire height when the cap is unscrewed for the first time; and at least one relief zone arranged in said anti-tamper strip and being substantially adjacent to said rupture point, said relief zone forming a region on said anti-tamper strip having an increased stretchability, such that said stretchability increases towards said lower edge of said anti-tamper strip.

2. The screw cap of claim 1, wherein the relief zone possesses the form of a material thinning extending in the screwing on direction towards the lower edge of the anti-tamper strip and/or a material weakening increasing in the downward direction, extending over at least a part of the anti-tamper strip.

3. The screw cap of claim 1, wherein the anti-tamper strip comprises:

a circumferential section along which the anti-tamper strip is permanently connected to the lower edge of the cap, a complementary section along which said anti-tamper strip is connected to the lower edge of the cap by means of tearable bridges, and a nominal rupture point arranged at one or each of the two bordering areas between the sections.

4. The screw cap of claim 3, wherein said relief zone is arranged on the complementary section along which said anti-tamper strip is connected to the lower edge of the cap by means of tearable bridges.

5. The screw cap of claim 1, wherein the stretchable area of the relief zone extends at least over half the height of the anti-tamper strip.

6. The screw cap of claim 1, wherein, in relation to the direction of screwing on, the relief zone is arranged in front of the nominal rupture point.

7. A screw cap for closure of a container mouth, comprising:

a lower edge;

a circumferential anti-tamper strip of a plastic material arranged on said lower edge and integral therewith, said anti-tamper strip having an inside and a lower edge;

at least one retaining element arranged on said inside of said anti-tamper strip for engaging said anti-tamper strip beneath a protrusion on the container mouth;

at least one substantially vertical nominal rupture point circumferentially arranged on said anti-tamper strip and adapted to separate said anti-tamper strip over its entire height when the cap is unscrewed for the first time; and at least two relief zones arranged in said anti-tamper strip at opposite sides of said rupture point, said relief zones forming a region on said anti-tamper strip having an increased stretchability, such that said stretchability increases towards said lower edge of said anti-tamper strip.

8. The screw cap of claim 7, wherein the relief zones possess the form of a material thinning extending in the screwing on direction towards the lower edge of the anti-tamper strip and/or a material weakening increasing in the downward direction, extending over at least a part of the anti-tamper strip.

9. The screw cap of claim 7, wherein the anti-tamper strip comprises:

a circumferential section along which the anti-tamper strip is permanently connected to the lower edge of the cap, a complementary section along which said anti-tamper strip is connected to the lower edge of the cap by means of tearable bridges, and a nominal rupture point arranged at one or each of the two bordering areas between the sections.

10. The screw cap of claim 7, wherein the stretchable area of the relief zones extend at least over half the height of the anti-tamper strip.

11. The screw cap of claim 7, wherein said relief zones are substantially triangular and extend from the lower edge of the anti-tamper strip upward toward the screw cap.

12. The screw cap of claim 11, wherein the tip of the triangle points towards the screw cap and the opposite lower side coincides with the lower edge of the anti-tamper strip.

13. The screw cap of claim 12, wherein the angle at the tip of the triangle is between about 20° and 50°.

14. The screw cap of claim 13, wherein the angle at the tip of the triangle is approximately 35°.

15. A screw cap for closure of a container mouth, comprising:

a lower edge;

a circumferential anti-tamper strip of a plastic material arranged on said lower edge and integral therewith, said anti-tamper strip having an inside and a lower edge;

at least one retaining element arranged on said inside of said anti-tamper strip for engaging said anti-tamper strip beneath a protrusion on the container mouth;

at least one substantially vertical nominal rupture point circumferentially arranged on said anti-tamper strip and adapted to separate said anti-tamper strip over its entire height when the cap is unscrewed for the first time; and at least one relief zone arranged in said anti-tamper strip and being substantially adjacent to said rupture point, said relief zone extending from the lower edge of the anti-tamper strip upward toward the screw cap and having increasing wall thickness in the upwards direction, said relief zone forming a region on said anti-tamper strip having an increased stretchability, such that said stretchability increases towards said lower edge of said anti-tamper strip.

* * * * *